US008790088B2

(12) United States Patent
Dyer et al.

(10) Patent No.: US 8,790,088 B2
(45) Date of Patent: Jul. 29, 2014

(54) COMPRESSOR HAVING BLADE TIP FEATURES

(75) Inventors: John David Dyer, Flat Rock, NC (US); Madhusudan Rao Pothumarthi, Bangalore (IN); Lynn M. Naparty, Simpsonville, SC (US); Michael Ericson Friedman, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 506 days.

(21) Appl. No.: 13/091,059

(22) Filed: Apr. 20, 2011

(65) Prior Publication Data

US 2012/0269638 A1 Oct. 25, 2012

(51) Int. Cl.
*F04D 29/38* (2006.01)

(52) U.S. Cl.
USPC ..... 416/228; 416/235; 416/243; 416/223 R

(58) Field of Classification Search
USPC ..... 416/228, 223 R, 229 A, 235, 236 R, 243, 416/223 A, 231 B
See application file for complete search history.

(56) References Cited

U.S. PATENT DOCUMENTS

| | | | | |
|---|---|---|---|---|
| 4,875,831 | A * | 10/1989 | Fetiveau | 416/228 |
| 5,476,363 | A * | 12/1995 | Freling et al. | 415/173.1 |
| 6,086,328 | A * | 7/2000 | Lee | 416/97 R |
| 6,206,642 | B1 * | 3/2001 | Matheny et al. | 416/230 |
| 6,402,474 | B1 * | 6/2002 | Okuno | 416/190 |
| 2004/0013518 | A1 * | 1/2004 | Booth | 415/173.4 |
| 2004/0241003 | A1 * | 12/2004 | Roy et al. | 416/236 R |
| 2007/0077149 | A1 * | 4/2007 | Lejars et al. | 416/223 R |
| 2010/0329875 | A1 * | 12/2010 | Kray et al. | 416/223 R |
| 2011/0044800 | A1 * | 2/2011 | Cornelius et al. | 415/173.1 |
| 2011/0070072 | A1 * | 3/2011 | Subramaniyan | 415/173.2 |

FOREIGN PATENT DOCUMENTS

WO WO 2006/015899 A1 * 2/2006 ..... F04D 29/16

* cited by examiner

*Primary Examiner* — Nathaniel Wiehe
*Assistant Examiner* — Aaron Jagoda
(74) *Attorney, Agent, or Firm* — Fletcher Yoder, P.C.

(57) ABSTRACT

A compressor having a compressor blade with a blade tip portion configured to reduce stresses in the blade tip of the compressor blade is provided. The compressor blade includes a first and second faces extending to the blade tip portion. The blade tip portion includes a blade tip, a first recess extending between the first face and the blade tip, and a second recess extending between the second face and the blade tip.

19 Claims, 4 Drawing Sheets

FIG. 1
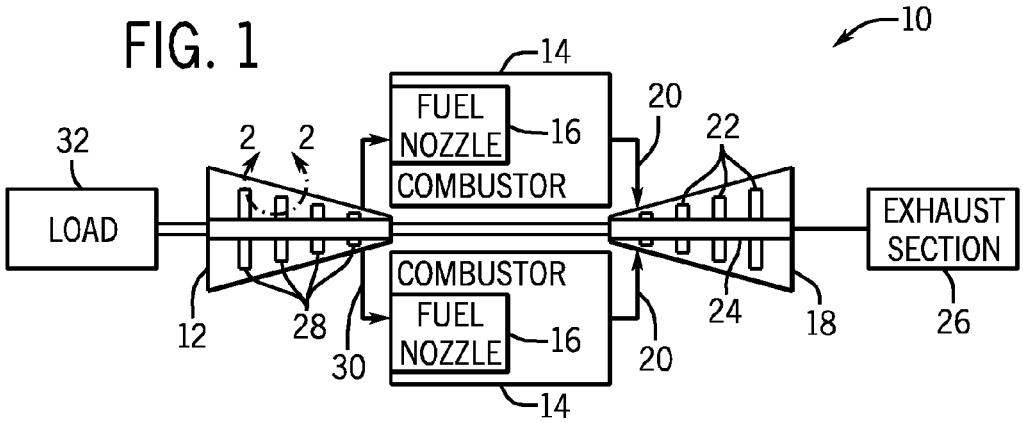
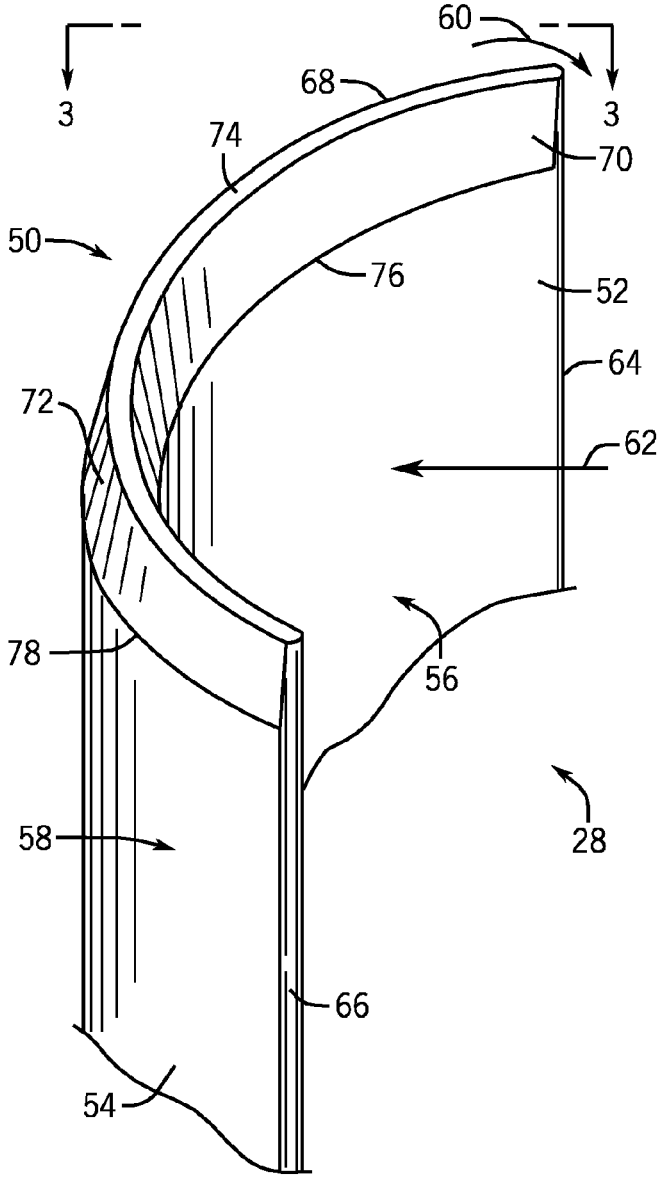
FIG. 2

COMPRESSOR HAVING BLADE TIP FEATURES

BACKGROUND OF THE INVENTION

The subject matter disclosed herein relates to compressors and, more particularly, to a compressor blade tip geometry for reducing tip stresses and increasing tip rub tolerance.

Gas turbine systems typically include at least one gas turbine engine having a compressor, a combustor, and a turbine. The compressor is configured to use compressor blades to compress and feed air into the combustor for combustion with fuel. For instance, the compressor blades may extend radially outwards from a supporting rotor disk, and the rotation of the compressor blades may force air into the combustor. Unfortunately, compressor blades experience high stresses due to elevated temperatures, fatigue, and elevated pressures. Additionally, the tips of compressor blades can potentially rub against the wall of the compressor, adding additional stress to the tip portions of the compressor blades. The high stresses experienced by compressor blades may cause the tips to suffer from tip liberations, such as cracks or fractures. In certain circumstances, cracks or fractures may cause leakage around the tips of the compressor blades, which subsequently decreases the efficiency of the compressor. As a result, damaged compressor blades may require that the compressor be shut down to repair or replace the damaged compressor blades.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a compressor having a plurality of compressor blades coupled to a rotor. Each compressor blade has a first and second face extending to a blade tip portion. The blade tip portion has a blade tip, a first recess between the first face and the blade tip, and a second recess between the second face and the blade tip.

In a second embodiment, a system includes a compressor blade having a blade tip extending between a leading edge and a trailing edge. The compressor blade also had a first recess extending along a first side of the blade tip between the leading edge and the trailing edge and a second recess extending along a second side of the blade tip between the leading edge and the trailing edge. The first and second recesses of the compressor blade are configured to reduce stress in the compressor blade.

In a third embodiment, a system includes a compressor blade having a tip, a first recess disposed on a first side of the blade tip, and a second recess disposed on a second side of the blade tip. The first and second recesses of the compressor blade are asymmetrical relative to the blade tip.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein:

FIG. 1 is a schematic of an embodiment of a gas turbine system including a compressor having a compressor blade configured to reduce stresses in a blade tip portion;

FIG. 2 is a partial perspective view of an embodiment of a compressor blade, taken within line 2-2 of FIG. 1, illustrating a blade tip portion with first and second recesses disposed on opposite sides of the compressor blade to reduce stresses in the blade tip portion;

DETAILED DESCRIPTION OF THE INVENTION

Figure 3:
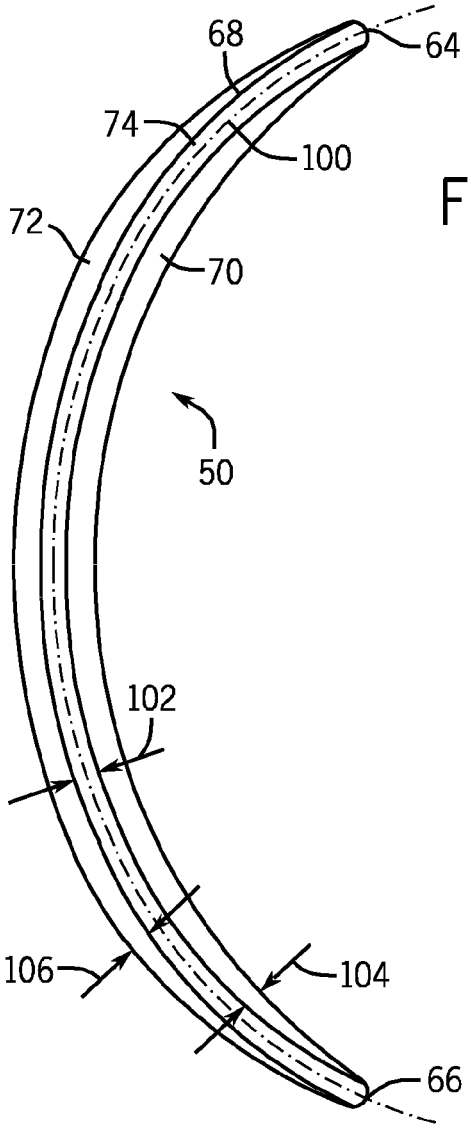
FIG. 3 is a top view of an embodiment of the compressor blade of FIG. 2, taken along line 3-3.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

As discussed further below, certain embodiments of the present disclosure provide a compressor that includes compressor blades configured for enhanced stress reduction at the blade tips. For instance, in one embodiment, the compressor blade may include a blade tip portion having a blade tip, a first recess between a first face of the blade and the blade tip, and a second recess between a second face of the blade and the blade tip. The first and second recesses may extend along the blade tip between a leading edge and a trailing edge of the compressor blade. This blade tip portion geometry may be referred to as a double sided squealer tip. The first and second recesses may be formed by removing some blade material at the tip of the blade, while maintaining a mean camber line along the tip of the blade. As used herein, the term "camber line" shall be understood to refer to the curve that is halfway between the pressure side and the suction side of the compressor blade. As will be appreciated, the formation of the two recesses may further reduce stresses at the blade tip and potentially increase rub tolerance at the blade tip, allowing for tighter blade clearances within the compressor case.

The first and second recesses may extend between a leading edge of the compressor blade and a trailing edge of the compressor blade. Furthermore, the first and second recesses may have similar or different configurations. For example, in some embodiments, the first and second recesses may be symmetrical with respect to the blade tip. In other embodiments, the first and second recesses may be asymmetrical with respect to the blade tip. More specifically, in certain embodiments, the respective depths and/or widths of the first and second recesses may be symmetrical or asymmetrical with respect to the blade tip. Furthermore, the respective configurations of the first and second recesses may be symmetrical or asymmetrical with respect to the blade tip. The shapes may include tapered recesses, concave recesses, convex recesses, S-shaped recesses, curved recesses, or any combination thereof. The geometry of the opposite first and second recesses may be specifically selected to reduce stresses in the blade tip, and may be tailored to operational parameters of the compressor, e.g., pressure, temperature, rotational speed, clearance, materials, and so forth.

Turning now to the drawings, FIG. 1 illustrates a block diagram of an embodiment of a gas turbine system 10 having compressor blades 28 with double-sided squealer tips. The system 10 includes a compressor 12, combustors 14 having fuel nozzles 16, and a turbine 18. The fuel nozzles 16 route a liquid fuel and/or gas fuel, such as natural gas or syngas, into the combustors 14. The combustors 14 ignite and combust a fuel-air mixture, and then pass hot pressurized combustion gases 20 (e.g., exhaust) into the turbine 18. Turbine blades 22 are coupled to a shaft 24, which is also coupled to several other components throughout the turbine system 10, as illustrated. As the combustion gases 20 pass through the turbine blades 22 in the turbine 18, the turbine 18 is driven into rotation, which causes the shaft 24 to rotate. Eventually, the combustion gases 20 exit the turbine 18 via an exhaust outlet 26.

In the illustrated embodiment, the compressor 22 includes compressor blades 28 with double-sided squealer tips to reduce stresses in the blade tips of the blades 28. The blades 28 within the compressor 12 are coupled to the shaft 24, and rotate as the shaft 24 is driven to rotate by the turbine 18, as discussed above. As the blades 28 rotate within the compressor 12, the blades 28 compress air from an air intake into pressurized air 30, which may be routed to the combustors 14, the fuel nozzles 16, and other portions of the gas turbine system 10. The fuel nozzles 14 may then mix the pressurized air and fuel to produce a suitable fuel-air mixture, which combusts in the combustors 14 to generate the combustion gases 20 to drive the turbine 18. Further, the shaft 24 may be coupled to a load 32, which may be powered via rotation of the shaft 24. By way of example, the load 32 may be any suitable device that may generate power via the rotational output of the turbine system 10, such as a power generation plant or an external mechanical load. For instance, the load 32 may include an electrical generator, a propeller of an airplane, and so forth.

FIG. 2 is a partial perspective view of an embodiment of a compressor blade 28, taken within line 2-2 of FIG. 1, illustrating a blade tip portion 50 having opposite recesses configured to reduce stresses in the blade tip of the compressor blade 28. More specifically, the compressor blade 28 has a first face 52 and a second face 54 that extend to the blade tip portion 50. As will be appreciated, the first face 52 may be a pressure side 56 of the compressor blade 28, and the second face 54 may be a suction side 58 of the compressor blade 28. More particularly, as the compressor blade 28 rotates about the shaft 24 in a direction 60, the air within the compressor 12 may cause a pressure force to build against the first face 52, as indicated by reference numeral 62. Furthermore, as illustrated, the first face 52 and the second face 54 may be joined together at a leading edge 64 and a trailing edge 66. Additionally, the leading edge 64 may be the upstream end of the compressor blade 28, and the trailing edge 66 may be the downstream end of the compressor blade 28. In certain embodiments, the first face 52 (i.e., the pressure side 56) may have a concave surface, and the second face 54 (i.e., the suction side 58) may have a convex surface. In other embodiments, the first face 52 and the second face 54 may each have a substantially planar surface.

As shown in the illustrated embodiment, the blade tip portion 50 includes a blade tip 68, a first recess 70, and a second recess 72. The first recess 70 and the second recess 72 may be formed by removing material from both sides of the blade tip 68 of the compressor blade 28. In other words, the first recess 70 may be formed by removing material from the pressure side 56 of the blade tip 68, and the second recess 72 may be formed by removing material on the suction side 58 of the blade tip 68. The blade tip 68 has a middle portion 74, which may be unmodified to maintain a mean camber line. Moreover, the first recess 70 may transition back to the first face 52 at an edge 76. Similarly, the second recess 72 may transition back to the second face 54 at an edge 78. As discussed below, in certain embodiments, the first recess 70 and the second recess 72 may extend between the leading edge 64 and the trailing edge 66, along the blade tip 68. Further, the first recess 70 and the second recess 72 may be formed using a variety of machining processes. For example, the first recess 70 and the second recess 72 may be formed by milling or turning. As discussed in further detail below, the first recess 70 and the second recess 72 may have a variety of geometries, e.g., shapes and dimensions. In some embodiments, the first recess 70 and the second recess 72 may have identical or similar geometries, such as shapes and dimensions. For example, the first and second recesses 70 and 72 may have similar curvatures, lengths, and widths, and the recesses 70 and 72 may be symmetric. In certain embodiments, the first and second recesses 70 and 72 may be substantially different from one another, e.g., different shapes and dimensions. Furthermore, the recesses 70 and 72 may be asymmetric. However, each embodiment of the recesses 70 and 72 is configured to reduce stresses in the blade tip portion 50.

FIG. 3 is a top view of an embodiment of the compressor blade 28 of FIG. 2, taken along line 3-3, illustrating the blade tip portion 50 having opposite recesses configured to reduce stresses in the blade tip 68. More specifically, the illustrated embodiment shows the blade tip 68, the first recess 70, and the second recess 72. As previously mentioned, the middle portion 74 of the blade tip 68 remains unmodified to maintain a mean camber line 100. The illustrated embodiment shows the blade tip 68 having a thickness 102 that is uniform. For example, the thickness 102 of the blade tip 68 may be approximately constant (e.g., approximately 1 to 5 mm, 5 to 10 mm, or 10 to 15 mm) between the leading edge 64 and the trailing edge 66 of the compressor blade 28. Due to the uniform thickness 102 of the blade tip 68, the first recess 70 and the second recess 72 extend completely or continuously from the leading edge 64 to the trailing edge 66. Similarly, the first recess 70 may have a thickness 104 and the second recess 72 may have a thickness 106. In the illustrated embodiment, the thickness 104 and the thickness 106 are approximately equal as the first recess 70 and the second recess 72 extend between the leading edge 64 and the trailing edge 66. For example, the thickness 104 and the thickness 106 may be approximately 1 to 5 mm or 5 to 10 mm.

Figure 4:
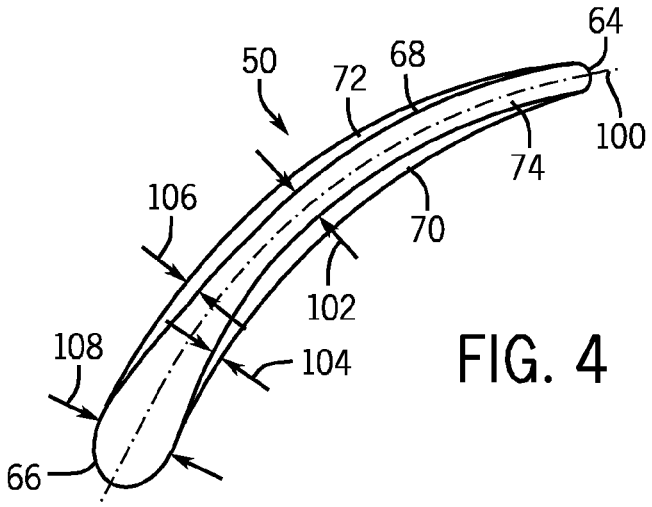
FIG. 4 is a top view of an embodiment of the compressor blade of FIG. 2, taken along line 3-3.

FIG. 4 is a top view of an embodiment of the compressor blade 28 illustrating the blade tip portion 50 having opposite recesses configured to reduce stresses in the blade tip 68. More specifically, the blade tip portion 50 includes the blade tip 68 having a varying thickness 102. For example, the thickness 102 of the blade tip 68 may be approximately 1-2 mm at the leading edge 64, and the thickness 102 may increase linearly (i.e., at a constant rate) to approximately 5 to 10 mm or 10 to 15 mm at the trailing edge 66. However, the dimensions may vary between different implementations of the blade tip portion 50. Furthermore, the thickness 102 may increase linearly or nonlinearly from the leading edge 64 to the trailing edge 66. For example, the thickness 102 may increase by a factor of approximately 0.1 to 50, 0.1 to 20, or 0.1 to 10 from the leading edge 64 to the trailing edge 66. Consequently, the first recess 70 and the second recess 72 may not extend entirely from the leading edge 64 to the trailing edge 66. In the illustrated embodiment, the first recess 70 and the second recess 72 extend partially along the blade tip 68. In other words, as the thickness 102 of the blade tip 68 increases, a width 104 of the first recess 70 may decrease, a width 106 of the second recess 72 may decrease, or both the widths 104 and 106 may decrease. Furthermore, as the thickness 102 of the blade tip 68 approaches a thickness 108 of the compressor blade 28, the first recess 70 and the second recess 72 may no longer continue along the blade tip 68. Accordingly, the illustrated recesses 70 and 72 extend to the leading edge 64, but do not fully extend to the trailing edge 66. However, the double-sided squealer tip provided by the recesses 70 and 72 substantially reduces stresses in the blade tip portion 50 to reduce the possibility of stress cracks, breakage, or general failure of the compressor blades 28.

FIGS. 5-13 illustrate various embodiments of the blade tip portion 50 having opposite recesses configured to reduce stresses in the blade tip 68 of the compressor blade 28. As mentioned above, the first recess 70 and the second recess 72 may comprise a wide variety of configurations including similar or different curvatures, tapers, and dimensions. Furthermore, the first recess 70 and the second recess 72 may be symmetrical relative to the blade tip 68, or the first recess 70 and the second recess 72 may be asymmetrical relative to the blade tip 68, as discussed in further detail below.

Figure 5:
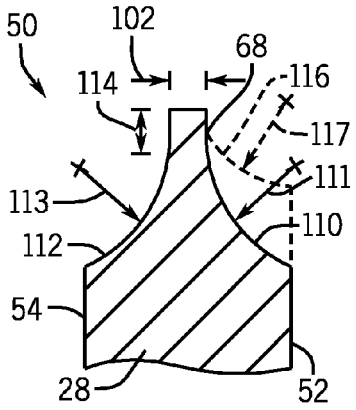
FIG. 5 is a cross-sectional side view of an embodiment of the blade tip portion of FIG. 2, illustrating opposite first and second concave recesses configured to reduce stresses in the blade tip portion.

FIG. 5 is a cross-sectional side view of an embodiment of the blade tip portion 50 of the compressor blade 28 having recesses 110 and 112 configured to reduce stresses in the blade tip 68. As shown, the blade tip portion 50 includes the blade tip 68, a first concave recess 110, and a second concave recess 112. As mentioned above, the blade tip 68 has a thickness 102. Further, the blade tip 68 may have a height 114. For example, the height 114 of the blade tip 68 may be approximately 1 to 10 mm, 2 to 8 mm, or 3 to 5 mm. As shown, the first concave recess 110 extends between the first face 52 and the blade tip 68. Similarly, the second concave recess 112 extends between the second face 54 and the blade tip 68. As will be appreciated, a radius of curvature 111 for the first concave recess 110 and a radius of curvature 113 for the second concave recess 112 may vary. For example, the radii of curvature 111 and 113 for the first concave recess 110 and the second concave recess 112 may be approximately 1 to 50 mm, 2 to 25 mm, or 5 to 10 mm. In certain embodiments, the radii of curvature 111 and 113 for the first concave recess 110 and the second concave recess 112 may be equal. In other embodiments, the first concave recess 110 and the second concave recess 112 may have different radii of curvature 111 and 113. For example, the first concave recess 110 may be modified, as indicated by the dotted line 116, to have a radius of curvature 117, which is substantially different from the radius of curvature 113 of the second concave recess 112. In either case, the radii 111 and 113 may be selected to reduce stresses in the blade tip portion 50.

Figure 6:
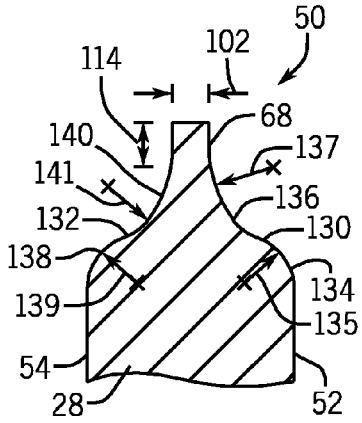
FIG. 6 is a cross-sectional side view of an embodiment of the blade tip portion of FIG. 2, illustrating opposite first and second S-shaped recesses configured to reduce stresses in the blade tip portion.

FIG. 6 is a cross-sectional side view of an embodiment of the blade tip portion 50 of the compressor blade 28 having opposite recesses 130 and 132 configured to reduce stresses in the blade tip portion 50. The blade tip portion 50 includes the blade tip 68, a first S-shaped recess 130, and a second S-shaped recess 132. As previously mentioned, the blade tip 68 has a thickness 102 and a height 114. The first S-shaped recess 130 extends between the first face 52 and the blade tip 68. Similarly, the second S-shaped recess 132 extends between the second face 54 and the blade tip 68. As illustrated, the first S-shaped recess 130 has a convex portion 134 and a concave portion 136. Similarly, the second S-shaped recess 132 has a convex portion 138 and a concave 140. In one embodiment, the convex portions 134 and 138 and the concave portions 136 and 140 may have the same radii of curvature 135, 137, 139, and 141, such as approximately 1 to 50 mm, 2 to 25 mm, or 5 to 10 mm. In other embodiments, the convex portions 134 and 138 and the concave portions 136 and 140 may have varying radii of curvature 135, 137, 139, and 141. For example, the convex portion 134 of the first S-shaped recess 130 and the convex portion 138 of the second S-shaped recess 132 may both have a first radii of curvature 135 and 139, while the concave portion 136 of the first S-shaped recess 130 and the concave portion 140 of the second S-shaped recess 132 may both have a second radii of curvature 137 and 141. In some embodiments, the first and second radii of curvature are equal, whereas other embodiments may have different first and second radii of curvature. In still further embodiments, the radii of curvature 135, 137, 139, and 141 may all equal or differ from one another. Thus, the radii of curvature 135, 137, 139, and 141 may be selected specifically to reduce stresses in the blade tip portion 50.

Figure 7:
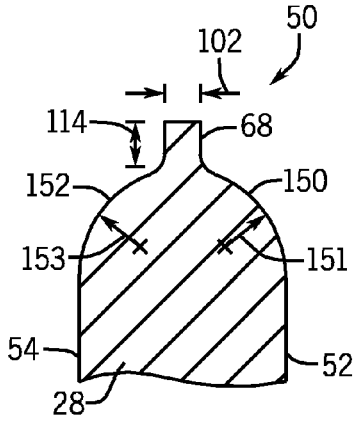
FIG. 7 is a cross-sectional side view of an embodiment of the blade tip portion of FIG. 2, illustrating opposite first and second convex recesses configured to reduce stresses in the blade tip portion.

FIG. 7 is a cross-sectional side view of an embodiment of the blade tip portion 50 of the compressor blade 28 illustrating the blade tip 68, a first convex recess 150, and a second convex recess 152. As previously discussed, the blade tip portion 50 has the recesses 150 and 152 configured to reduce stresses in the blade tip 68. As shown in the illustrated embodiment, the first convex recess 150 extends between the first face 52 of the compressor blade 28 and the blade tip 68. Further, the second convex recess 152 extends between the second face 54 of the compressor blade 28 and the blade tip 68. In certain embodiments, the first convex recess 150 and the second convex recess 152 may have equal or different radii of curvature 151 and 153. For example, the radii of curvature 151 and 153 for the first convex recess 150 and the second convex recess 152 may be approximately 1 to 50 mm, 2 to 25 mm, or 5 to 10 mm. Again, the radii of curvature 151 and 153 may be selected to reduce stresses in the blade tip portion 50.

Figure 8:
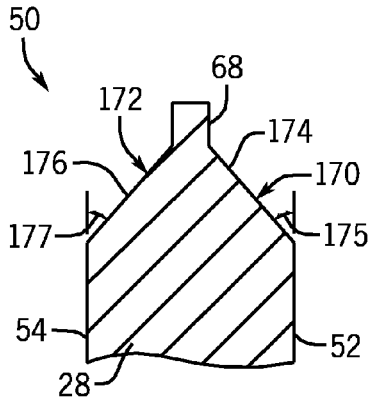
FIG. 8 is a cross-sectional side view of an embodiment of the blade tip portion of FIG. 2, illustrating opposite first and second tapered recesses configured to reduce stresses in the blade tip portion.

FIG. 8 is a cross-sectional side view of an embodiment of the blade tip portion 50 of the compressor blade 28 having opposite recesses 170 and 172 configured to reduce stresses in the blade tip portion 50. Specifically, the illustrated embodiment includes a first tapered recess 170 and a second tapered recess 172 configured to reduce stresses in the blade tip 68. As shown, the first tapered recess 170 has a straight or flat surface 174 extending between the first face 52 of the compressor blade 28 and the blade tip 68. Similarly, the second tapered recess 172 has a straight or flat surface 176 extending from the second face 54 of the compressor blade 28 and the blade tip 68. While the first tapered recess 170 and the second recess 172 are symmetrical with respect to the blade tip 68 in the illustrated embodiment, the first tapered recess 170 and the second tapered recess 172 may be asymmetrical with respect to the blade tip 68 in other embodiments. As illustrated, the surface 174 of the first tapered recess 170 has a first angle 175 relative to the first face 52, and the surface 176 of the second tapered recess 172 has a second angle 177 relative to the second face 54. In certain embodiments, the angles 175 and 177 may be equal or different from one another. For example, the angle 175 may be greater than the angle 177, or the angle 177 may be greater than the angle 175. The angles 175 and 177 may range between approximately 5 to 80 degrees or may be less than approximately 5, 10, 15, 20, 25, 30, 40, 50, 60, 70, or 80 degrees. The angles 175 and 177 may be specifically selected to reduce stresses in the blade tip portion 50.

Figure 9:
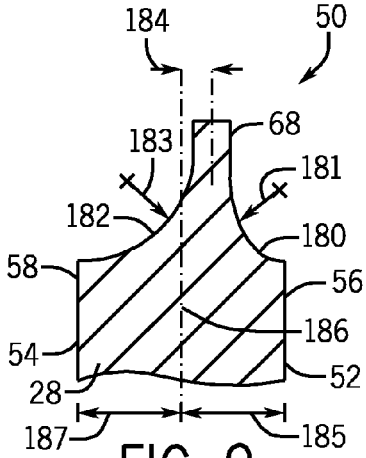
FIG. 9 is a cross-sectional side view of an embodiment of the blade tip portion of FIG. 2, illustrating first and second concave recesses asymmetrically arranged about opposite sides of the blade tip.

FIG. 9 is a cross-sectional side view of an embodiment of the blade tip portion 50 of the compressor blade 28 having opposite recesses 180 and 182 configured to reduce stresses in the blade tip portion 50. The illustrated embodiment includes a first concave recess 180 and a second concave recess 182 configured to reduce stresses in the blade tip 68. As shown, the first concave recess 180 extends from the first face 52 of the compressor blade 28 to the blade tip 68. Similarly, the second concave recess 182 extends from the second face 54 of the compressor blade to the blade tip 68. Further, the first concave recess 180 and the second concave recess 182 are asymmetrical with respect to the blade tip 68. Thus, the first and second concave recesses 180 and 182 may have radii of curvature 181 and 183, which are different from one another at least partially due to the asymmetry. In particular, the blade tip 68 is offset a distance 184 relative to a mean camber line 186 extending between the leading edge and the trailing edge of the compressor blade 28. For example, the distance 184 may be approximately 1 to 95 percent, 5 to 75 percent, 10 to 50 percent, or 20 to 40 percent of a distance 185 from the camber line 186 toward the first face 52 or a distance 187 from the camber line 186 toward the second face 54. For example, the distance 184 may be approximately 1 to 10 mm, 1 to 5 mm, or 2 to 3 mm. As shown, the blade tip 68 is offset the distance 184 towards the pressure side 56 of the compressor blade 28 (i.e., a fraction of the distance 185). In other embodiments, the blade tip 68 may be offset from the mean camber line 186 towards the suction side 58 of the compressor blade 28 (i.e., a fraction of the distance 187). The radii of curvature 181 and 183 and the distance 184 may be specifically selected to reduce stresses in the blade tip portion 50.

Figure 10:
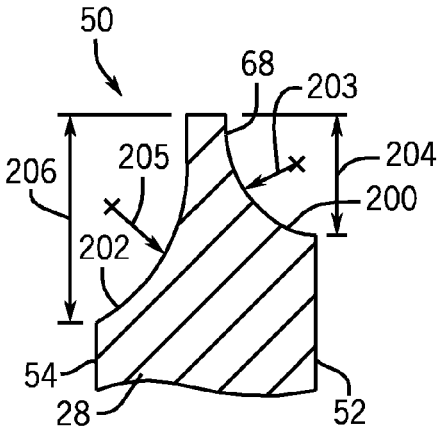
FIG. 10 is a cross-sectional side view of an embodiment of the blade tip portion of FIG. 2, illustrating first and second concave recesses asymmetrically arranged about opposite sides of the blade tip.

FIG. 10 is a cross-sectional side view of an embodiment of the blade tip portion 50 of the compressor blade 28 having opposite recesses 200 and 202 configured to reduce stresses in the blade tip portion 50. As shown, the blade tip portion 50 includes a first concave recess 200, which extends between the first face 52 of the compressor blade 28 and the blade tip 68. Additionally, the blade tip portion 50 includes a second concave recess 202, which extends between the second face 54 of the compressor blade 28 and the blade tip 68. Furthermore, the first concave recess 200 and the second concave recess 202 are asymmetrical with respect to the blade tip 68. In particular, the first concave recess 200 has a radius of curvature 203 and a height 204, while the second concave recess 202 has a radius of curvature 205 and a height 206. For example, the height 206 of the second concave recess 202 may be greater than the height 204 of the first concave recess 200 by a factor of approximately 1.05 to 10, 1.1 to 5, or 1.5 to 2. By further example, the height 204 may be approximately 1 to 5 mm, while the height 206 may be approximately 2 to 10 mm. Again, the radii of curvature 203 and 205 and the heights 204 and 206 may be specifically selected to reduce stresses in the blade tip portion 50.

Figure 11:
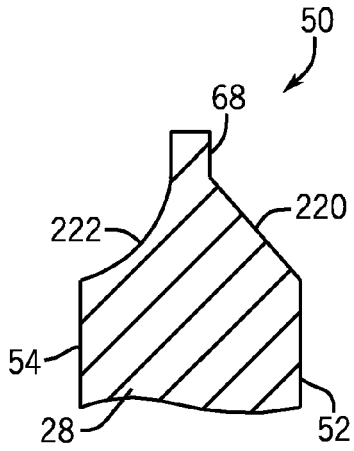
FIG. 11 is a cross-sectional side view of an embodiment of the blade tip portion, illustrating a first concave recess and a second tapered recess asymmetrically arranged about opposite sides of the blade tip.

FIG. 11 is a cross-sectional side view of an embodiment of the blade tip portion 50 of the compressor blade 28 having opposite recesses 220 and 222 configured to reduce stresses in the blade tip 68. Specifically, the illustrated embodiment includes first and second recesses 220 and 222 having different shapes. As shown, the blade tip portion 50 includes a first recess 220 having a tapered shape, and a second recess 222 having a concave shape. The first recess 220 extends between the first face 52 of the compressor blade 28 and the blade tip 68, and the second recess 222 extends between the second face 54 of the compressor blade 28 and the blade tip 68. As previously discussed, the blade tip portion 50 may having different shapes or configurations of recesses 220 and 222 on the pressure side 56 and the suction side 58 of the compressor blade 28 to reduce stresses in the blade tip portion 50.

Figure 12:
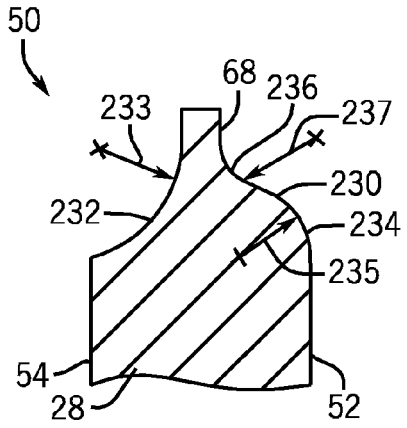
FIG. 12 is a cross-sectional side view of an embodiment of the blade tip portion, illustrating a first concave recess and a second S-shaped recess asymmetrically arranged about opposite sides of the blade tip.

FIG. 12 is a cross-sectional side view of an embodiment of the blade tip portion 50 of the compressor blade 28, illustrating a first recess 230 and a second recess 232 that are asymmetrical relative to the blade tip 68. More particularly, the first recess 230 and the second recess 232 have different shapes. The first recess 230 extends between the first face 52 of the compressor blade 28 and the blade tip 68, and has an S-shaped geometry. As discussed above, the S-shaped geometry may include a convex portion 234 and a concave portion 236. In certain embodiments, the radii of curvature 235 and 237 for the convex portion 234 and the concave portion 236 of the first recess 230 may be equal or different from one another. For example, the radii of curvature 235 and 237 may be approximately 1 to 50 mm, 2 to 25 mm, or 5 to 10 mm. Furthermore, the second recess 232 of the blade tip portion 50 extends between the second face 54 of the compressor blade 28 and the blade tip 68, and has a concave shape. The second recess 232 has a radius of curvature 233, which may be equal to or different from the radii of curvature 235 and 237. Again, the radii of curvature 233, 235, and 237 may be specifically selected to reduce stresses in the blade tip portion 50.

Figure 13:
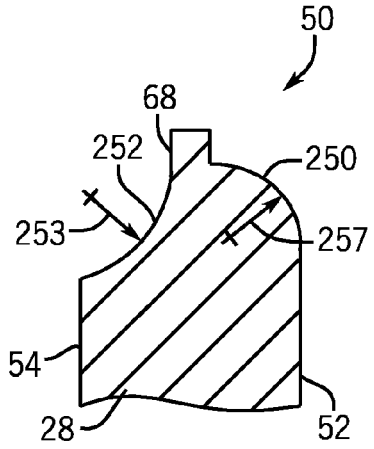
FIG. 13 is a cross-sectional side view of an embodiment of the blade tip portion, illustrating a first concave recess and a second convex recess asymmetrically arranged about opposite sides of the blade tip.

FIG. 13 is a cross-sectional side view of an embodiment of the blade tip portion 50 of the compressor blade 28, illustrating a first recess 250 and a second recess 252 that are asymmetrical relative to the blade tip 68. Additionally, the first recess 250 and the second recess 252 have different shapes.

Specifically, the first recess 250 extends between the first face 52 of the compressor blade 28 and the blade tip 68, and has a convex shape. The second recess 252 extends between the second face 54 of the compressor blade 28 and the blade tip 68, and has a concave shape. Although the first recess 250 and the second recess 252 have different shapes (i.e., concave and convex), the first recess 250 and the second recess 252 may have radii of curvature 251 and 253, which are equal or different from one another. For example, the radii of curvature 251 and 253 may be approximately 1 to 50 mm, 2 to 25 mm, or 5 to 10 mm. Again, the configuration and radii of curvature 251 and 253 of the recesses 250 and 252 may be specifically selected to reduce stresses in the blade tip portion 50.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a compressor, comprising:

a plurality of compressor blades coupled to a rotor; wherein each compressor blade of the plurality of compressor blades comprises first and second external faces extending to a blade tip portion, wherein the blade tip portion comprises a blade tip, a first externally facing recess having a first profile with a first curvature or a first taper between the first external face and the blade tip, and a second externally facing recess having a second profile with a second curvature or a second taper between the second external face and the blade tip, wherein the first and second externally facing recesses are directly opposite from one another, and wherein the first and second profiles of the respective first and second recesses extend lengthwise along the blade tip portion between a leading edge and a trailing edge of the compressor blade, wherein the first and second externally facing recesses of each compressor blade of the plurality of compressor blades are asymmetrical relative to the blade tip, and wherein the first and second externally facing recesses of each compressor blade of the plurality of compressor blades comprise respective first and second depths that are asymmetrical relative to the blade tip.

2. The system of claim 1, wherein the first and second externally facing recesses of each compressor blade of the plurality of compressor blades are configured to reduce stress in the blade tip portion.

3. The system of claim 1, wherein the first and second externally facing recesses of each compressor blade of the plurality of compressor blades extend along the blade tip from the leading edge to the trailing edge.

4. The system of claim 1, wherein the blade tip of each compressor blade of the plurality of compressor blades is centered along a camber line of the compressor blade.

5. The system of claim 1, wherein the first and second profiles are asymmetrical relative to the blade tip.

6. The system of claim 1, wherein the first and second externally facing recesses of each compressor blade of the plurality of compressor blades comprise respective first and second widths that are asymmetrical relative to the blade tip.

7. The system of claim 1, wherein at least one of the first or second externally facing recesses of each compressor blade of the plurality of compressor blades comprises a concave surface.

8. The system of claim 1, wherein at least one of the first or second externally facing recesses of each compressor blade of the plurality of compressor blades comprises a convex surface.

9. The system of claim 1, wherein at least one of the first or second externally facing recesses of each compressor blade of the plurality of compressor blades comprises a tapered surface.

10. The system of claim 1, comprising a gas turbine engine having the compressor.

11. A system, comprising:

a compressor blade comprising a blade tip extending between a leading edge and a trailing edge, a first externally facing recess having a first curvature or a first taper extending along a first side of the blade tip between the leading edge and the trailing edge, and a second externally facing recess opposite from the first externally facing recess and having a second curvature or a second taper extending along a second side of the blade tip between the leading edge and the trailing edge, wherein the first and second externally facing recesses are configured to reduce stress in the compressor blade, wherein at least one of the first or second externally facing recesses comprises an S-shaped external recess.

12. The system of claim 11, wherein at least one of the first or second externally facing recesses comprises at least one of a concave external surface, a convex external surface, or a tapered external surface.

13. The system of claim 11, wherein the blade tip is centered along a camber line extending between the leading edge and the trailing edge of the compressor blade.

14. The system of claim 11, wherein the first and second externally facing recesses are asymmetrical relative to the blade tip.

15. The system of claim 11, comprising a compressor having the compressor blade.

16. A system, comprising:

a compressor blade comprising a blade tip, a first external recess disposed on a first side of the blade tip, and a second external recess disposed on a second side of the blade tip directly opposite from the first external recess, wherein the first and second external recesses are asymmetrical relative to the blade tip, wherein the first external recess and the second external recess comprise respective first and second depths that are asymmetrical relative to the blade tip.

17. The system of claim 16, wherein the first and second external recesses comprise respective first and second curvatures that are asymmetrical relative to the blade tip.

18. The system of claim 16, wherein the blade tip, the first external recess, and the second external recess extending between a leading edge and a trailing edge, and the blade tip is offset relative to a camber line extending between the leading edge and the trailing edge.

19. A system, comprising:

a compressor blade comprising a blade tip extending between a leading edge and a trailing edge, a first external recess extending along a first side of the blade tip between the leading edge and the trailing edge, and a second external recess extending along a second side of the blade tip between the leading edge and the trailing edge, wherein the first and second external recesses are configured to reduce stress in the compressor blade, and wherein at least one of the first or second external recesses comprises an S-shaped external recess, the first and second external recesses comprise respective first and second depths that are asymmetrical relative to the blade tip, or both.

* * * * *